United States Patent [19]

Vidalis

[11] 4,305,169

[45] Dec. 15, 1981

[54] METHOD FOR CONTINUOUSLY TREATING FABRIC

[75] Inventor: Theodore Vidalis, Athens, Greece

[73] Assignee: Printaire Systems, Inc., Dalton, Ga.

[21] Appl. No.: 110,637

[22] Filed: Jan. 9, 1980

[51] Int. Cl.[3] ..... D06B 5/08; D06B 11/00

[52] U.S. Cl. ..... 8/149; 8/151; 8/477; 68/200; 101/129; 118/410; 427/244; 427/272

[58] Field of Search ..... 8/147, 148, 149, 149.2, 8/151, 477; 68/5 D, 5 E, 5 A, 183, 200, 204, 205 R; 427/244, 272, 282; 118/406, 410; 156/78; 261/DIG. 26

[56] References Cited

U.S. PATENT DOCUMENTS

| | | | |
|---|---|---|---|
| 2,533,167 | 12/1950 | Kilham | 68/183 X |
| 2,981,631 | 4/1961 | Nagel | 156/78 X |
| 3,042,573 | 7/1962 | Roberts | 118/301 X |
| 3,047,418 | 7/1962 | Compton | 427/282 X |
| 3,063,952 | 11/1962 | Vieli | 261/DIG. 26 |
| 3,197,324 | 7/1965 | Brooks | 118/406 X |
| 3,302,564 | 2/1967 | Wilford . | |
| 3,533,834 | 10/1970 | Marzocchi . | |
| 3,697,314 | 10/1972 | Stritzko . | |
| 4,023,526 | 5/1977 | Ashmus . | |
| 4,158,076 | 6/1979 | Walsten . | |
| 4,159,355 | 6/1979 | Kaufman . | |

*Primary Examiner*—Philip R. Coe
*Attorney, Agent, or Firm*—James B. Middleton

[57] ABSTRACT

A carpet printing method is disclosed, and an apparatus for carrying out the method. The method includes the steps of supporting a piece of fabric on a perforate belt, generating a foam adjacent to the fabric and directing the foam through the belt to treat the fabric. The apparatus includes a pan having pipes for admitting dye and air into the pan to generate a foam. A belt is disposed across the open top of the pan, the belt carrying the fabric. The air both foams the liquid and provides pressure within the pan to urge the foam through the belt and into the fabric.

5 Claims, 18 Drawing Figures

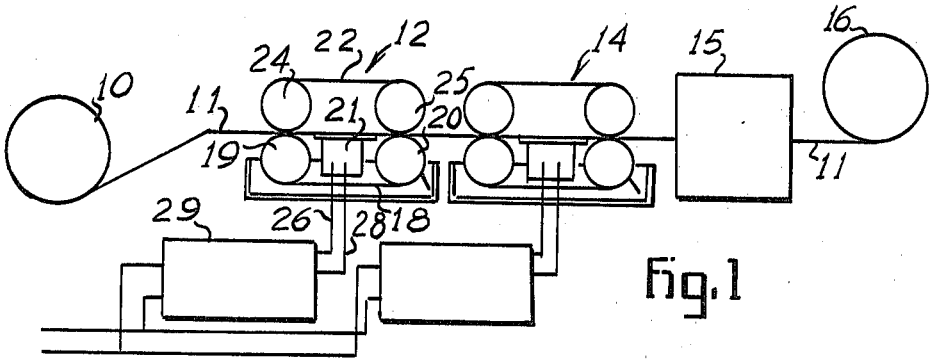
Fig. 1
Fig. 2
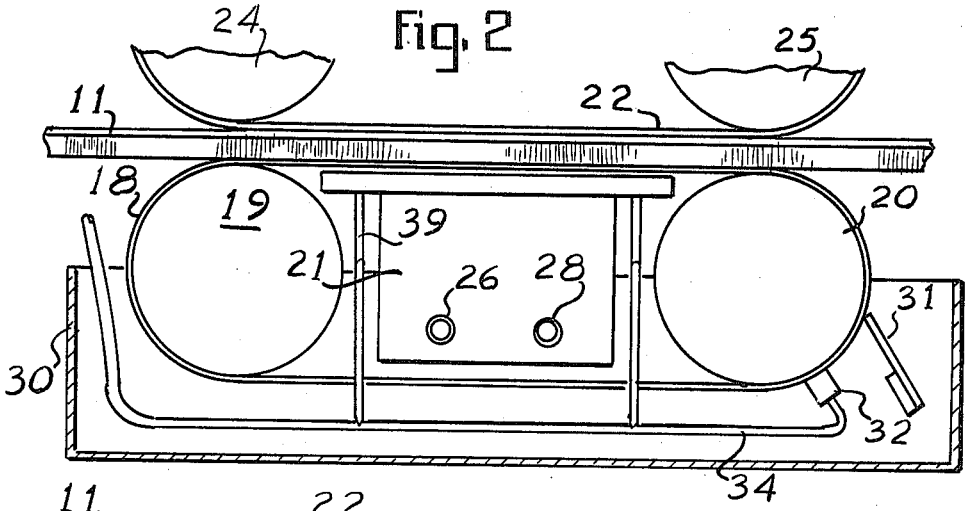
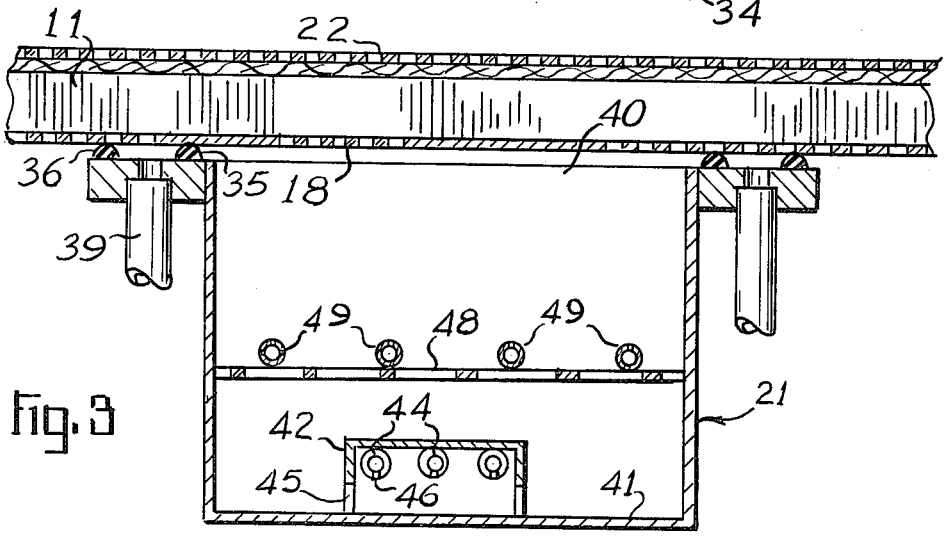
Fig. 3

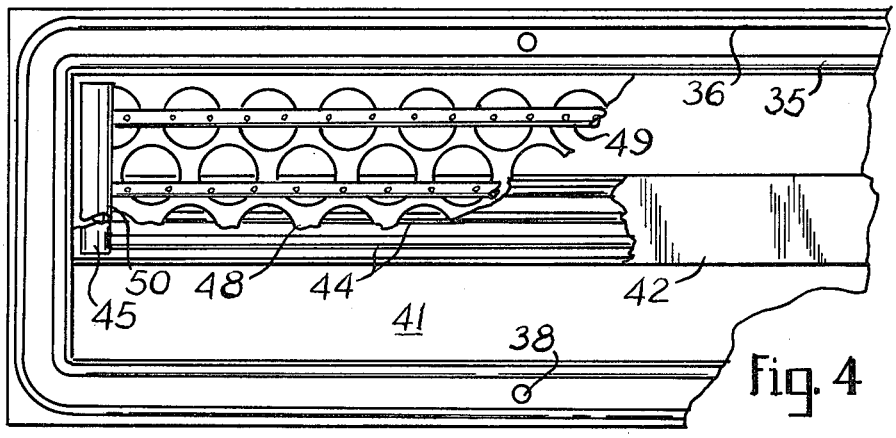
Fig. 4
Fig. 5
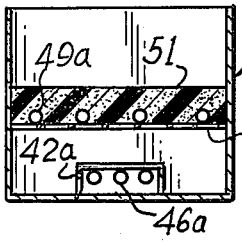
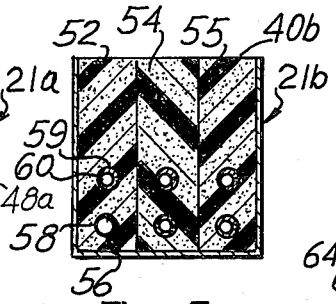
Fig. 6
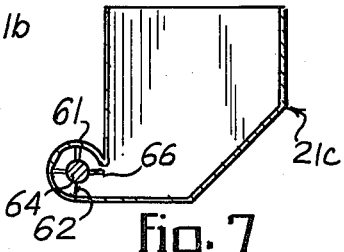
Fig. 7
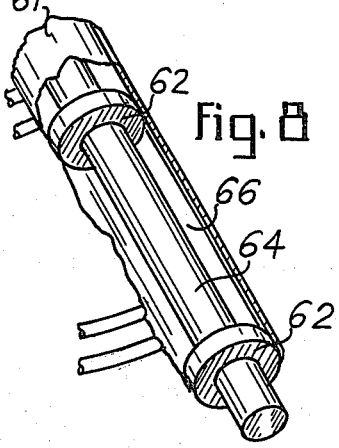
Fig. 8
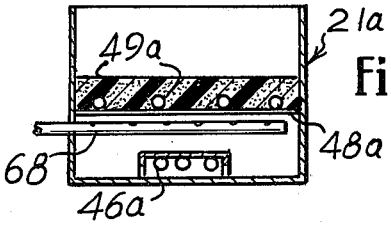
Fig. 9
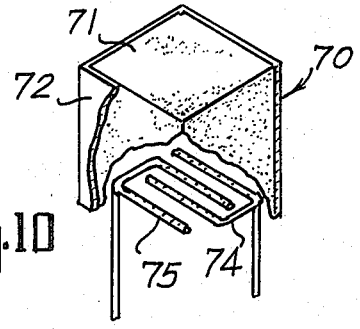
Fig. 10

METHOD FOR CONTINUOUSLY TREATING FABRIC

FIELD OF THE INVENTION

This invention relates generally to the treatment of carpets and other pile fabrics, and is more particularly concerned with a method and apparatus for continuously treating pile fabrics, either uniformly or in a predetermined pattern.

BACKGROUND OF THE INVENTION

There have been many efforts at printing carpeting, and many different techniques have been devised. Apparatus for printing carpeting falls generally into one of two categories. There is intermittent printing wherein a discrete section of the carpeting is placed with respect to the printing means, the printing is accomplished, and the carpeting is moved to expose a new section of carpeting to the printing means. Also, there is continuous printing wherein the carpeting moves continuously, and is printed continuously. The prior art continuous printing apparatus has generally included rotary printers utilizing either a roller or a belt to transfer an image to a continuously moving carpet. The rollers have included the use of an intaglio design which is filled with dye to be transferred to the carpeting, or a raised design, the raised portion being coated with dye to be subsequently transferred to a continuously moving carpet. The belt arrangements have included generally a silk screen arrangement whereby dye is passed through the belt and onto a continuously moving carpet. There have also been efforts to print a design by disposing a plurality of spray nozzles adjacent to a continuously moving carpet, and controlling the spraying of the various nozzles to apply the desired color at the desired time.

With the prior art techniques and apparatus for printing carpet, there have been the continual problems of precisely defining a pattern without blurring or smearing, especially if the pattern is one that required sharp lines and careful definition. Some of the prior art techniques have also had difficulty in applying the right amount of dye stuff to the various areas of the carpeting to achieve the desired amount of dye saturation and penetration of the pile fabric. In much of the prior art apparatus, when the proper amount of dye has been applied to the carpeting, the carpeting must be steamed in order to set the dye, then washed thoroughly and dried. This finishing of the carpeting required extremely large amounts of energy both in the setting of the dye and in the final drying of the carpet. There have been some efforts in the prior art to treat carpeting through the use of a foamed material, but the prior art apparatus has generally required that the foam be generated remotely and handled extensively before being applied to the carpeting. As a result, the chemistry for the foam has been rather elaborate, requiring materials to maintain the foam for extended periods of time which may further result in the necessity for mechanical breakdown of the foam when the foam is ultimately applied to the fabric to make the foam penetrate the fabric.

SUMMARY OF THE INVENTION

The present invention overcomes the above mentioned and other difficulties with the prior art printing methods and apparatus by providing a pan having an open top, and means for supporting a carpet for traversing the open top of the pan and means for holding the carpet against the support. Means for generating a foam is provided in the pan, the foam passing through the open top of the pan to engage the carpet for treating the carpet. The means for generating the foam within the pan comprises generally a source of liquid within the pan, and a source of gas under pressure within the pan for foaming the liquid. The pan may further include means for generating more than one color of foam for applying more than one color, or more than one treatment, to the carpet in one pass over the pan. The means for supporting the carpet includes porous and nonporous areas for selectively treating selected areas of the carpet. Additionally, a plurality of the devices may be arranged in series for multiple successive treatments.

BRIEF DESCRIPTION OF THE DRAWINGS

These and other features and advantages of the present invention will become apparent from consideration of the following specification when taken in conjunction with the accompanying drawings in which:

FIG. 1 is a schematic representation showing one form of continuous carpet treating apparatus made in accordance with the present invention;

FIG. 2 is an enlarged side elevational view showing one of the carpet treating stations shown in FIG. 1 of the drawings;

FIG. 3 is a further enlarged cross-sectional view through the pan shown in FIG. 2 of the drawings, and showing a length of carpeting thereover;

FIG. 4 is a partial top plan view of the pan shown in FIG. 3 of the drawings, various portions of the apparatus being broken away to show the construction;

FIGS. 5–7 are cross-sectional views showing three modified forms of pan for use in the embodiment of the invention shown in FIG. 1 of the drawings;

FIG. 8 is a perspective view showing the mechanical foam producing apparatus utilized in the device shown in FIG. 7;

FIG. 9 is a cross-sectional view similar to FIG. 5 but including means for introducing a second color of dye;

FIG. 10 is a perspective view, partially broken away, showing a foam generating capsule receivable within one of the pans of the present invention;

DESCRIPTION OF THE PREFERRED EMBODIMENTS

Figure 11:
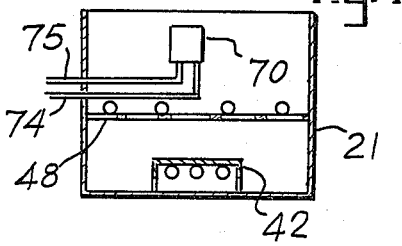
FIG. 11 is a cross-sectional view showing the capsule of the FIG. 10 within the pan of FIG. 3.

Referring now more particularly to the drawings and to those embodiments of the invention here presented by way of illustration, in FIG. 1 it will be seen that there is a roll 10 of carpeting or other fabric 11, the fabric 11 being directed along a path through a first continuous treating apparatus generally designated at 12 and through a second continuous treating apparatus generally designated at 14. As the fabric 11 emerges from the apparatus 14, the fabric will be directed into finishing equipment generally designated at 15. Those skilled in the art will realize that the finishing equipment 15 will be conventional apparatus including a steamer or other means necessary to set the dye into the fabric, and necessary washing apparatus and drying apparatus as is conventional and well known in the art. As the carpet 11 emerges from the finishing equipment 15, the carpet will be placed into a roll 16 as finished carpeting.

While the conventional finishing apparatus 15 will include substantially conventional dryers and the like, those skilled in the art will realize that the processes in accordance with the present invention will provide for a lower moisture content in the fabric 11 emerging from the last treating apparatus 14, so the dryers of the finishing equipment 15 will not be required to remove as much moisture.

As here shown in FIG. 1, there are two continuous treating devices 12 and 14; however, it will be understood that only one such device may be used if desired, or any greater number of devices may be used for various forms of treatment, and/or to print a multiple colored pattern on the fabric 11.

It will also be understood that the two devices 12 and 14 are substantially identical, and only one such device will be discussed in detail hereinafter.

The device shown in FIG. 1, and designated as the device 12, includes a printing belt 18 which may be considered as a belt, screen or the like. The belt 18 is trained over a pair of rollers 19 and 20 to define an upper flight and a lower flight of the belt 18, and to define a space between the rollers 19 and 20. A pan 21 is received within the space between the rollers 19 and 20, the pan 21 having its open top adjacent to the upper flight of the belt 18 so that a foam generated within the pan 21 can pass through the open top of the pan 21 and pass through the screen 18 to engage the carpet, or fabric 11.

Opposing the belt 18, there is a hold down means, here shown as a top belt 22. The top belt 22 will also be a screen or other arrangement that will allow fluid to escape from the back side of the fabric 11. The top belt 22 is held in place on two rollers 24 and 25 which are here shown as substantially vertically aligned with the rollers 19 and 20.

It will further be seen in FIG. 1 of the drawings that there is a line 26 for conveying dye liquor or other treating liquid to the pan 21, and there is another line 28 for conducting air or other gas to the pan 21. The lines 26 and 28 pass through metering equipment generally designated at 29.

It will be understood that the metering equipment 29 is conventional equipment well known to those skilled in the art, and is therefore not here shown in detail. Though the use of this equipment will be discussed in more detail hereinafter, it should be understood generally that the gas and liquid are metered into the pan 21 to provide a constant supply of foam, the liquid being supplied sufficiently to replace the amount taken up by the fabric 11, and the gas being supplied in sufficient quantity to yield the desired blow ratio of the foam.

Looking now at FIG. 2 of the drawings, it will be seen that the rollers 19 and 20 have a catch pan 30 therebeneath. It will be understood that dye or other treating liquid will be carried by the belt 18 away from the fabric 11, and the residuum must be removed before the particular portion of the belt 18 again contacts the fabric 11 to prevent an undesirable carryover. To aid in this removal, there is a doctor blade 31 which engages the printing surface of the belt 18 and scrapes the surface to remove any excess treating liquid. Any liquid removed will simply drip into the catch pan 30. It may be desirable, either alone or in conjunction with the doctor blade 31, to provide a vacuum head 32 adjacent to the belt 18 for removing excess liquid therefrom. The vacuum head 32 can be connected to a vacuum line 34 which may totally remove the liquid from the vicinity of the treating device 12.

The initial removal of excess material from the belt 18 is by means of seals 35 and 36 which are shown in FIGS. 3 and 4 of the drawings, in addition to FIG. 2. It will be seen that there is an inner seal 35 surrounding the open top of the pan 21, and the belt 18 engages the seal 35. One of the purposes of the seal 35 is to assure that the foam generated within the pan 21 will be directed through the open holes in the screen 18 and pass through the screen 18 into the fabric 11. It is of course a secondary advantage that the seal 35 will tend to scrape the belt 18 clean at each side of the pan 21.

The seal 35 is generally parallel to an outer seal 36 which is slightly spaced from the seal 35. The seal 36 provides further assurance that the foam generated within the pan 21 will not escape and contaminate the area, and also assists in cleaning the belt 18.

It will further be seen that there are holes 38 located between the inner and outer seals 35 and 36, the holes 38 being connected, with appropriate tubing or the like designated at 39, to the vacuum line 34. Thus, the seals 35 and 36 will engage the belt 18 and physically scrape the belt to remove excess material therefrom; also, there will be a vacuum applied between the seals 35 and 36 to assist further in removing excess material from the belt 18, the vacuum serving also to carry off liquid that might otherwise accumulate between the two seals 35 and 36.

Attention is next directed primarily to FIGS. 3 and 4 of the drawings for an understanding of the construction of the pan 21 and the foam generating means contained therein.

It will be seen that the pan 21 is generally a rectangular pan having an open top 40. Along the bottom 41 of the pan 21, there is an inverted channel member 42 having a plurality of tubes 44 mounted to the central web of the channel 42. The plurality of tubes 44 extend from a manifold 45 which is fed by the liquid supply line 28.

Throughout the length of the pan 21 (which extends transversely of the web of fabric 11) the side flanges of the channel 42 have openings 45 so that the interior of the channel 42 communicates with the interior of the pan 21.

It will now be understood that liquid is supplied to the manifold 45 and passes from the manifold 45 through the plurality of tubes 44. The tubes 44 have nozzles or openings 46 along their lengths so that liquid emerges from the various tubes 44 throughout the lengths of the tubes 44 through the various openings 46. The liquid coming from the various tubes 44 fills the interior of the channel 42, then passes from the interior of the channel 42, through the openings 45 and into the main body of the pan 21. Thus, it will be understood that the liquid may be forced through the plurality of tubes 44 and out through the nozzles 46 under some considerable pressure so that the liquid emerging through the nozzles 46 cause considerable turbulance. However, as the liquid accumulates within the channel 42, then passes through the openings 45 and into the main body of the pan 21, the turbulence is calmed, or at least severely diminished, so the surface of the liquid in the pan 21 will be substantially uniform.

There is a perforate shelf 48 extending across the pan 21, parallel to the bottom 41 of the pan 21. Extending along this shelf 48, there is a plurality of tubes 49 which are connected to a manifold 50, the manifold 50 being fed by the gas line 26. It will also be noticed that the tubes 49 include a plurality of apertures 51 throughout their lengths.

From the foregoing description, the general operation of the foam generating means should be understandable. Liquid is metered and admitted through the line 28 to feed the manifold 45 from which the liquid will flow through the various tubes 44 throughout the length of the pan 21. Due to the arrangement, it will be understood by those skilled in the art that liquid treating material will enter the pan 21 throughout its length. The arrangement will be such that the liquid will be admitted into the pan 21 to an extent that the liquid will rise to the level of the shelf 48, and somewhat thereabove. Since the shelf 48 is perforate, the shelf will offer no resistance to the flow of fluid therethrough. When the level of liquid reaches the nozzles 51 in the tubes 49, there will be gas passing from the line 26, into the manifold 50 and through the various tubes 49 and out the nozzles 51 so that the gas will bubble through the liquid causing a frothing of the liquid to generate a foam. It will be understood that the liquid contains a surfactant to cause the generation of foam so that foam will fill the upper portion of the pan 21, and reach the open top 40 of the pan 21.

With attention directed especially to FIG. 3 of the drawings, it will be seen that the foam to be generated substantially at the shelf 48 is quite close to the fabric 11 to be treated by the foam. It will therefore be understood that the foam need not have a very long life, or half-life, because the foam is generated and almost immediately utilized. The foam will be generated somewhat above the shelf 48, extend to the open top 40 of the pan 21, and pass through the belt, or screen 18 to engage to fabric 11 and cause appropriate treatment. The hold down means merely holds the fabric 11 against the belt 18, but otherwise does not inhibit the process.

One of the novel points of the present invention is the use of a single source of pressure both to create foam and to urge the foam into the fabric to be treated. The gas entering the pan 21 through the various tubes 49 will serve to create a foam from the liquid; however, this incoming gas will also generate a positive pressure within the pan 21. It has been found that this pressure is sufficient to urge the foam through the belt 18, and into the fabric 11, without the aid of additional mechanical, vacuum or other means to assist in causing the foam to penetrate the fabric 11.

Looking next at FIG. 5 of the drawings, there is shown a modified form of the pan 21, the pan being here designated as 21*a*. The pan 21*a* includes a shelf 48*a* having a plurality of tubes 49*a* disposed thereon, and the bottom 41*a* of the pan 21*a* has the channel 42*a* with the plurality of tubes 46*a* within the channel.

The only difference between the pan 21*a* and the pan 21 is the inclusion of a porous block 50 which rests on the shelf 48*a* and covers the tubes 49*a*.

Those skilled in the art will realize that many different specific materials may be used for the porous block 50, but it has been found that an open cell, expanded polyurethane works quite well. The polyurethane is nonreactive with most of the dyes and other chemicals used in treating carpeting so that the polyurethane will not enter into the treatment process. The purpose of the block 50 is to allow the liquid which comes from below as previously discussed to rise through the perforate shelf 48*a* and engage the porous block 50. It will be understood that the capillary action will tend to distribute the liquid uniformly throughout the bottom surface of the porous block 50, and eventually throughout the block 50 to some extent.

The gas which enters the porous block 50 by means of the tubes 49*a* will be broken up into small streams by the cellular structure of the porous block 50, so that the gas and liquid are totally intermingled within the block 50. As a result, foam will be formed primarily at the upper surface 51 of the block 50, and the foam will tend to be formed substantially uniformly throughout the surface 51 of the block 50. As a result, there will be completely uniform production of foam throughout the pan 21*a*.

Attention is next directed to FIG. 6 of the drawings which shows another modified form of pan 21, the pan in FIG. 6 being designated 21*b*. In FIG. 6, it will be seen that there are three porous blocks designated at 52, 54 and 55. Within each of the blocks 52, 54 and 55, there are two tubes. Since each of the blocks 52, 54 and 55 is constructed and functions the same way, only the block 52 will be described in detail.

There is a lower pipe 56 which extends the full length of the pan 21*b*, the pipe 56 having holes, or nozzles, 58. The pipe 56 is designed to carry air or other gas for creating foam. Above the pipe 56, there is a pipe 59 for carrying the liquid, the pipe 59 having nozzles 60 therein.

It will now be understood that, in general, gas is admitted through the pipe 56, and is dispensed through the holes 58 so that the gas escapes into the cellular structure of the block 52. Simultaneously, liquid is admitted through the pipe 59 and exits through the holes 60 to escape into the cellular structure of the block 52. Since the gas pipe 56 is below the liquid pipe 59, it will be understood that liquid cannot fall to the bottom of the pan 21*b*; rather, liquid will be engaged by the gas under pressure and forced to the top 40*b* of the pan 21*b*.

It will thus be seen that the embodiment of the invention shown in FIG. 6 of the drawings provides a novel arrangement wherein the foam generating means can be produced in modules and stacked, or placed together as desired. While the device shown in FIG. 6 includes a separate pan 21*b*, those skilled in the art will realize that each of the blocks 52, 54 and 55 can have its own separate pan, or the foam may have sufficient "skin" that no additional pan is required.

FIGS. 7 and 8 of the drawings disclose a modified foam generating apparatus wherein mechanical forces are utilized to assist in generating the foam. There is a pan 21*c* having a generally cylindrical foam generator 61 along the side of the pan 21*c* and communicating therewith. The foam generator 61 is shown in more detail in FIG. 8 of the drawings where it will be seen that the cylindrical housing is divided longitudinally by a plurality of bearings 62 which both divide the housing and journal a shaft 64.

Between each pair of bearings 62, there is a tube 46*c* for admitting liquid into the housing 61, and a tube 49*c* for admitting gas into the housing 61.

It should now be understood that liquid and gas are admitted through the tubes 46*c* and 49*c* to enter the housing 61 between the pair of bearings 62. Means will be provided for rotation of the shaft 64; and, rotation of the shaft 64 while the housing 61 remains stationary will set up shear forces within the housing 61 to assist in agitating the gas and liquid within the housing 61. If desired, paddles, fingers, or the like may be attached to the shaft 64 for more vigorous agitation which will generate a foam. As is best shown in FIG. 7, the housing 61 is open, to communicate with the pan 21*c* at 66; therefore, as foam is generated within the housing 61, the foam passes through the opening 66 and into the pan 21*c* to fill the pan 21*c*.

One advantage of the foam generating means shown in FIGS. 7 and 8 of the drawings is that different amounts of foam may be produced along the length of the pan 21*c*, or slightly different formulations of foam may be produced throughout the length as may be required in any particular installation.

FIG. 9 of the drawings discloses an embodiment of the invention similar to the device shown in FIG. 5, and the same reference numerals are used for the same parts. The one addition in the embodiment of FIG. 9 is the second-liquid pipe 68.

While the second-liquid pipe 68 is here shown as simply a single pipe extending transversely of the pan 21*a* in FIG. 9, it will be understood that two or more such pipes may be included throughout the length of the pan 21*a*; or, a single pipe 68 may be utilized but appropriately bent to wend its way as desired throughout the pan 21*a*.

In operation of the device shown in FIG. 9 of the drawings, a first liquid, for example one color of dye, will be admitted through the pipes 46*a* to fill the lower part of the pan 21*a* and be foamed by gas admitted through the pipes 49*a*. In addition to this arrangement, as discussed in connection with FIG. 5, the pipe 68 would have a second liquid, perhaps a different color of dye, admitted immediately below the shelf 48*a* to yield areas of foam with different characteristics. It is contemplated that the metering equipment 29 will be arranged to provide short bursts of the second liquid from the pipe 68 in accordance with a predetermined pattern.

FIG. 10 of the drawings discloses a capsule similar to the embodiment of the invention disclosed in FIG. 6 of the drawings. The capsule 70 includes a block of porous foam 71 having a pan, skin or the like 72 covering the sides and bottom. Generally at the bottom of the capsule 70, there are liquid pipes 74 and gas pipes 75. From the foregoing discussion, it should be obvious that liquid would be admitted through the pipe 74 and gas would be admitted through the pipe 75, both the liquid and the gas being released within the porous block 71. The result will be that foam will be generated at the top of the capsule 70.

Figure 12:
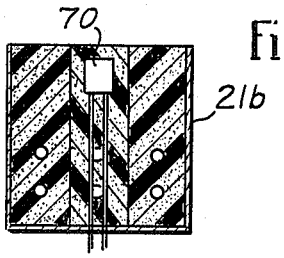
FIG. 12 is a cross-sectional view showing the capsule of FIG. 10 in the pan of FIG. 6 of the drawings.

The purpose of the capsule 70 is to provide a device disposable at will within one of the pans such as the pan 21. By way of example, FIG. 11 of the drawings shows the pan 21 having a capsule 70 disposed therein, and FIG. 12 of the drawings shows the pan 21*b* having the capsule 70 disposed within the block 54.

It will be understood that the foams contemplated herein have a degree of integrity, even though the foam is not long-lived, so that the foam generated by the capsule 70 within the pan 21, 21*b* or the like, will not disperse homogeneously throughout the foam generated, but will remain somewhat in a single area. The result will be a spot, or a plurality of spots, that can be changed at will while the overall treating device will produce a single foam. The capsule 70 can therefore be used for streaks of a different color or the like, the metering equipment 29 controlling the capsule 70 for the desired pattern.

From the foregoing discussion, it should now be understood that each of the embodiments of the present invention provides for introduction of a treating liquid, such as a dye, into a pan such as a pan 21, and the introduction of a gas, such as air, into the pan 21. The liquid dye will include a conventional surfactant, preferably a non-ionic surfactant because of the other chemicals involved, those skilled in the art realizing that the presence of a surfactant will cause the dye to foam and maintain a foam for a short period of time. The foam is generated, in the embodiment in FIG. 3 of the drawings, substantially at the nozzles of the air pipes 49 so that, as the level of liquid rises and engages the pipe 49, the liquid will be turned into a foam, and foam will fill the remainder of the pan 21.

Due to the fact that the foam is generated adjacent to the fabric 11, the foam can have an extremely short life. It will be seen that, in each of the embodiments herein disclosed, the foam is generated locally, and travels through a wide open pan a very short distance before engaging the fabric to be treated. The pan, such as the pan 21, has a positive pressure therein due to the supply of gas under pressure through the pipes such as the pipes 49, and this positive pressure tends to force the foam through the belt 18 and through the fabric to be treated.

Tests with apparatus made in accordance with the present invention have indicated that the particular formulation of a dye to be used in the apparatus is not critical. Some gum may be added if desired; however, even when gum has been added, the viscosity of the liquid has been in the range of 50 cps. This viscosity was achieved with about 1 gram of gum per liter of liquid.

Figure 13:
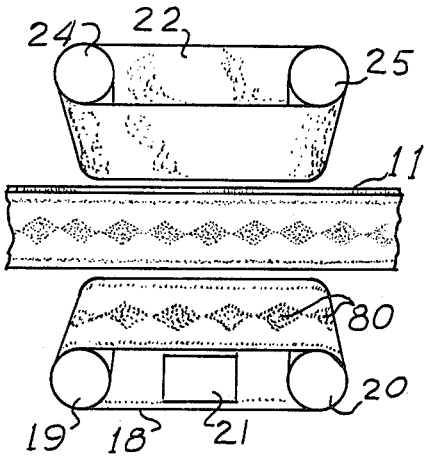
FIGS. 13–15 are exploded perspective views showing the various screen arrangements for providing a pattern to the treatment of the carpeting in accordance with the present invention.

Looking at FIG. 13 for a discussion of the use of the apparatus of the present invention, it will be seen that the belt 18 is provided with a plurality of holes 80 to create a pattern. From the foregoing discussion it will be readily realized that where the belt 18 has holes, the foam will pass therethrough and treat the fabric 11, and where the belt 18 is imperforate, the fabric will remain untreated. Thus, with an appropriate dye solution admitted into the pan 21 along with gas, a foam will be generated in the pan 21 and will pass through the holes 80 in the belt 18. With the fabric 11 in contact with the belt 18, the fabric 11 will be printed with the pattern on the belt 18. The top belt 22 allows the air to pass completely therethrough so that the fabric 11 will be completely penetrated by the foamed dye.

Figure 14:
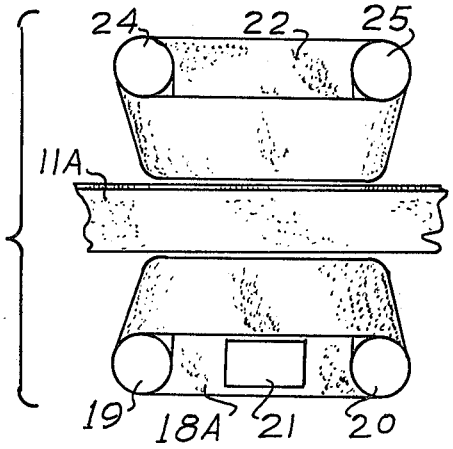

FIG. 14 of the drawings discloses an arrangement wherein the belt, here designated as 18A is uniformly perforated, or may be a screen or the like. With this arrangement, a foam uniformly generated within the pan 21 will treat the entire fabric 11A. It will be understood that this arrangement could be used for dyeing carpeting a solid color, or for treating a length of carpet with various chemicals.

It will also be realized that the arrangement as shown in FIG. 14 may be used with one or more of the capsules 70 for printing a variegated pattern on the carpet 11A. With a plurality of capsules 70 appropriately disposed in the pan 21, streaks can be formed on the carpet 11A, the streaks having a different color from the background color.

Figure 15:
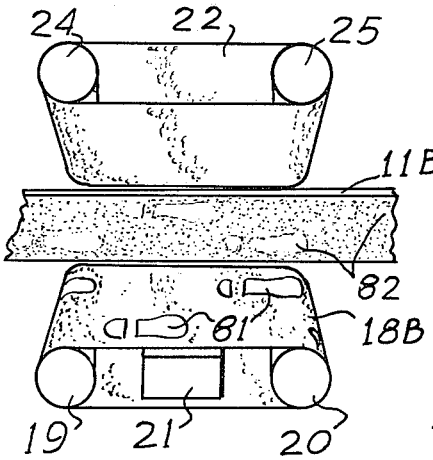

Looking next at FIG. 15, it will be seen that a belt 18B may be used which is substantially the reverse of the belt 18 disclosed in FIG. 13 of the drawings. The belt 18B is predominately an open mesh as in FIG. 14; however, the belt 18B has a plurality of appliques 81 thereon. The result will be that the carpet 11B will be treated substantially uniformly throughout; however, where the appliques 81 are located, there will be an untreated portion such as the portions 82 on the carpet 11B. It will of course be obvious that one or more capsules 70 may also be used in the pan 21 to provide a variegated background for the carpeting as shown in FIG. 15.

All of the above described embodiments of the present invention are arranged to have the fabric 11 pass over the printing device in a face-down mode. However, the present invention is also applicable to treating carpet or the like in a face-up mode, and one such arrangement is shown in FIG. 16 of the drawings.

Figure 16:
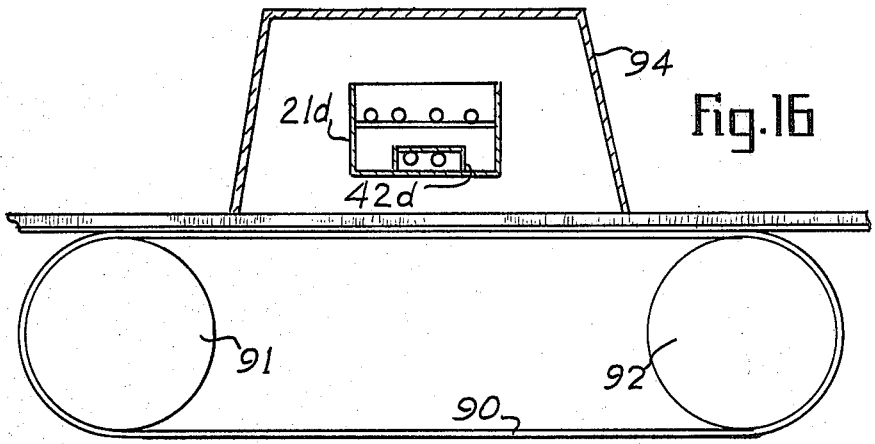
FIG. 16 is another modified form of the device of the present invention, arranged so the carpet is face up; and, FIGS. 17 and 18 are illustrations showing modified forms of apparatus to hold the back of the fabric against the stencil.

In FIG. 16, the carpet 11C is carried on a belt 90 which is trained over rollers 91 and 92, or is otherwise appropriately supported. The belt 90 should be a screen or otherwise allow fluid flow through the fabric 11C.

Above the fabric 11C, there is a pan **21*d* similar to the pan 21, the pan 21*d* having the inverter channel 42*d* in the bottom thereof, with tubes 46*d* within the channel 42*d***.

Above the channel **42*d*, there is a perforate shelf 48*d* having gas lines 49*d* thereon. Thus, it will be understood that the pan 21*d* is arranged similarly to the pan 21 so that liquid will be admitted into the pan, and the liquid level will rise to engage the pipes 49*d* where the liquid will be caused to foam. Foam will then fill the entire pan 21*d* and pass through the open top 40*d* of the pan 21*d***.

The difference in the device of FIG. 16 is the hood 94. In this embodiment of the invention, the foam is directed by the hood 94 to the carpet beneath the pan **21*d*. As here shown, there is no belt, stencil or the like between the foam and the carpet 11C** so the treatment will be uniform. However, it will be obvious that structure as described above can be used to create a pattern on the fabric.

It has been previously indicated that the hold-down means such as the top belt 22 must be such as to hold the fabric uniformly and to allow fluid to pass through the fabric, and no specific structure is required as long as these functions can be carried out. It should be realized, however, that insufficient pressure against the back of the fabric may allow the face of the fabric to leave the belt, or stencil, and allow a blurring of the intended pattern. Conversely, if too much pressure is applied, the face yarns in a pile fabric will be crushed and the dye will be transferred beyond the intended pattern. This is commonly known at "thatching", and causes undesirably smeared pattern lines.

Figure 17:
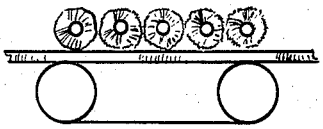

FIG. 17 of the drawings shows, rather schematically, another form of hold-down means. Here it will be seen that there is a plurality of rollers 95 spaced along the back of the fabric 11, each of the rollers 95, having bristles or the like extending therefrom. The arrangement is such that the rollers 95 will be rotated so the bristles will move at the same speed and in the same direction as the fabric, and the bristles will uniformly hold the fabric against the stencil.

Figure 18:
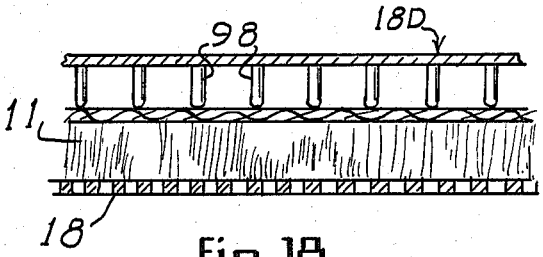

FIG. 18 of the drawings shows another variation of hold down means, the device in FIG. 18 including a belt 18D similar to the belt 18; but, instead of having the belt itself perforated, the belt 18D includes a plurality of protrusions, or fingers, 98 to bear against the fabric 11. Thus, fluid can pass through the fabric 11, between the fingers 98, and escape.

It should therefore be well understood that the hold-down device may take many different forms so long as the fabric is held uniformly, and fluid is allowed to pass freely through the fabric 11.

From the foregoing, it will be seen that the present invention provides an admirably simple means for printing, or uniformly treating, carpets and other pile fabrics. The use of foam greatly reduces the quantity of liquid that passes into a pile fabric so that subsequent finishing is much easier and less expensive. The foam generating and application means of the present invention allows the use of foam by generating the foam adjacent to the point of foam application and renders the physical make-up of the foam considerably less critical. As a result, the present invention can be used with the addition of well known penetrants, surfactants, gums or the like as desired for treatment of the particular carpeting or fabric involved. Also, the gas which bubbles through the liquid provides both the functions of agitating the liquid sufficiently to cause the foaming, and simultaneously adds the air necessary to provide the desired blow ratio of the foam. The gas creates an internal pressure to force the foam through the fabric, obviating the necessity for other means for assuring penetration.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. A process for treating fabric including the steps of generating a foam within an unobstructed pan having an open top, directing said foam towards said open top with the walls of said pan, placing a porous belt over the open top of said pan in sealing engagement therewith, placing said fabric on said belt, placing a porous means over said fabric for holding said fabric to assure that said fabric is against said belt, and maintaining said foam at a sufficiently high pressure that said foam passes through said porous belt and into said fabric for treatment of said fabric, and further characterized in that the step of generating a foam is carried out adjacent to said porous belt.

2. A process as claimed in claim 1, and including the step of treating selected areas of said fabric by passing said foam through said porous belt while covering other areas of said fabric with non-porous portions of said belt.

3. A process as claimed in claim 1, the step of generating foam including the step of placing a treating liquid into said pan to provide a level of said liquid, admitting gas into said pan a short distance below said level of said liquid so that gas agitates said liquid to generate said foam, and continuing so that said foam fills said pan above said level of said liquid and passes through said belt and into said fabric.

4. A process as claimed in claim 3, and including the step of admitting said gas under sufficient pressure so that gas pressure urges said foam through said fabric.

5. A process as claimed in claim 1, and including the step of moving said belt, said fabric, and said porous means, together with respect to said pan while retaining the sealing engagement between said belt and said pan.

* * * * *